US011587485B2

(12) United States Patent
Gao et al.

(10) Patent No.: US 11,587,485 B2
(45) Date of Patent: Feb. 21, 2023

(54) DISPLAY PANEL, METHOD FOR DRIVING THE SAME, AND DISPLAY DEVICE

(71) Applicant: SHANGHAI TIANMA AM-OLED CO., LTD., Shanghai (CN)

(72) Inventors: Yana Gao, Shanghai (CN); Xingyao Zhou, Shanghai (CN); Yue Li, Shanghai (CN); Xinzhao Liu, Shanghai (CN)

(73) Assignees: WUHAN TIANMA MICRO-ELECTRONICS CO., LTD., Wuhan (CN); WUHAN TIANMA MICROELECTRONICS CO., LTD. SHANGHAI BRANCH, Shanghai (CN)

( * ) Notice: Subject to any disclaimer, the term of this patent is extended or adjusted under 35 U.S.C. 154(b) by 219 days.

(21) Appl. No.: 16/838,994

(22) Filed: Apr. 2, 2020

(65) Prior Publication Data

US 2021/0201730 A1 Jul. 1, 2021

(30) Foreign Application Priority Data

Dec. 30, 2019 (CN) ..... 201911399728.5

(51) Int. Cl.
*G09G 3/20* (2006.01)

(52) U.S. Cl.
CPC ..... *G09G 3/20* (2013.01); *G09G 2310/0297* (2013.01); *G09G 2320/0233* (2013.01)

(58) Field of Classification Search
CPC ..... G09G 3/20; G09G 2310/0297; G09G 2320/0233
See application file for complete search history.

(56) References Cited

U.S. PATENT DOCUMENTS

2007/0146518 A1* 6/2007 Hong ..... G09G 3/3614 348/308
2015/0199936 A1* 7/2015 Watanabe ..... G09G 3/3685 345/100

(Continued)

FOREIGN PATENT DOCUMENTS

CN 1991546 A 7/2007
CN 1047788712 A 7/2015
CN 108376536 A 8/2018

OTHER PUBLICATIONS

CN 201911399728.5 First Office Action dated May 19, 2022, English translation.

*Primary Examiner* — Patrick N Edouard
*Assistant Examiner* — Eboni N Giles
(74) *Attorney, Agent, or Firm* — Alston & Bird LLP

(57) ABSTRACT

A display panel and a display device are provided. The display panel has a display area and a non-display area. The display panel includes pixels arranged in H columns and H*x data lines arranged in the display area and DEMUX circuits arranged in the non-display area. Each pixel includes x sub-pixels, and the data line is electrically connected to the sub-pixel. Each DEMUX circuit includes signal output terminals electrically connected to the data lines. The DEMUX circuits include M first DEMUX circuits and N second DEMUX circuits. Each first DEMUX circuit includes a first signal input terminal and al first signal output terminals. Each second DEMUX circuit includes a second signal input terminal and b1 second signal output terminals. H*x=M*a1+N*b1, where H, x, M, N, a1, and b1 are positive integers, M>N, a1>2, b1≥2, a1>b1, and (M+N) is an even number.

17 Claims, 11 Drawing Sheets

(56) References Cited

U.S. PATENT DOCUMENTS

| | | | | |
|---|---|---|---|---|
| 2016/0189644 | A1* | 6/2016 | So | G09G 3/3233<br>345/103 |
| 2017/0076665 | A1* | 3/2017 | Kim | G09G 3/3275 |
| 2019/0250479 | A1* | 8/2019 | Yeh | G02F 1/1368 |
| 2020/0082758 | A1* | 3/2020 | Yi | G09G 3/3258 |
| 2021/0233455 | A1* | 7/2021 | Yang | G09G 3/3291 |

* cited by examiner

DISPLAY PANEL, METHOD FOR DRIVING THE SAME, AND DISPLAY DEVICE

CROSS-REFERENCE TO RELATED APPLICATIONS

The present application claims priority to Chinese Patent Application No. CN201911399728.5, filed on Dec. 30, 2019, the content of which is incorporated herein by reference in its entirety.

TECHNICAL FIELD

The present disclosure relates to the field of display technologies, and in particular, to a display panel, a method for driving the display panel, and a display device.

BACKGROUND

A display panel provided in the related art usually has a relative high resolution, and a large number of data lines are provided in the display panel. In order to reduce the number of pads, a demultiplexer (DEMUX) circuit is typically provided in a non-display area. For example, with reference to FIG. 1, which illustrates a display panel provided in the related art, the display panel has a display area 001 and a non-display area 002. Multiple pixels 00 are arranged in the display area 001, each pixel includes a sub-pixel 01, a sub-pixel 02, and a sub-pixel 03. A data line 04 is electrically connected to the sub-pixel and is configured to transmit a data signal to the sub-pixel.

A DEMUX circuit 003 is provided in the non-display area 002. The DEMUX circuit 003 includes an input terminal electrically connected to an integrated circuit chip (IC) through a connection line 05 and an output terminal electrically connected to the data line 04. In the display panel shown in FIG. 1, a ratio of the number of input terminals of the DEMUX circuit 003 to the number of output terminals of the DEMUX circuit 003 is 1:3. Accordingly, the number of data lines 04 is an integral multiple of the number of output terminals of the DEMUX circuit. In some display panels in the related art, the DEMUX circuit has the ratio such as 1:6, 1:9, 1:12, or the like.

As display devices shapes vary more in non-rectangular display panels, such as circular display panels, the total number of data lines may not be an integral multiple of the number of output terminals of the DEMUX circuit. For example, in a display panel with a pixel-per-inch (PPI) of 392*392, since 392 cannot be exactly divided by 3, 6, 9, and 12, it makes it difficult to design the DEMUX circuit.

In addition, some display panels are sensitive to loads. Generally, a load difference of each set of data lines should be set as small as possible. When the number of data lines is not an integral multiple of the number of the output terminals of the DEMUX circuit, the DEMUX circuits will be asymmetric in the number, and a risk of uneven display will be exacerbated.

SUMMARY

In an aspect, an embodiment of the present disclosure provides a display panel having a display area and a non-display area. The display panel includes pixels arranged in H columns in the display area, each of which including x sub-pixels; H*x data lines arranged in the display area and electrically connected to the sub-pixels of the pixels; and a plurality of DEMUX circuits arranged in the non-display area, each of the plurality of DEMUX circuits including signal output terminals, and each of the signal output terminals being electrically connected to one of the H*x data lines. The plurality of DEMUX circuits includes M first DEMUX circuits and N second DEMUX circuits, each of the M first DEMUX circuits including a first signal input terminal and a1 first signal output terminals, and each of the N second DEMUX circuits including a second signal input terminal and b1 second signal output terminals. $H*x=M*a1+N*b1$, where H, x, M, N, a1, and b1 are positive integers, $M>N$, $a1>2$, $b1\geq 2$, $a1>b1$, and (M+N) is an even number.

In another aspect, an embodiment of the present disclosure provides a method for driving a display panel. The display panel having a display area and a non-display area. The display panel includes pixels arranged in H columns in the display area, each of which including x sub-pixels; H*x data lines arranged in the display area and electrically connected to the sub-pixels of the pixels; a plurality of DEMUX circuits arranged in the non-display area, each of the plurality of DEMUX circuits including signal output terminals, and each of the signal output terminals being electrically connected to one of the H*x data lines; and a1 control signal lines arranged in the non-display area. The plurality of DEMUX circuits includes M first DEMUX circuits and N second DEMUX circuits, each of the M first DEMUX circuits including a first signal input terminal and a1 first signal output terminals, and each of the N second DEMUX circuits including a second signal input terminal and b1 second signal output terminals. $H*x=M*a1+N*b1$, where H, x, M, N, a1, and b1 are positive integers, $M>N$, $a1>2$, $b1\geq 2$, $a1>b1$, and (M+N) is an even number. Each of the M first DEMUX circuit includes a1 first switches, input terminals of the a1 first switches being electrically connected to the first signal input terminal, an output terminal of each of the a1 first switches being electrically connected to one of the a1 first signal output terminals, and control terminals of the a1 first switches being electrically connected to the a1 control signal lines respectively. Each of the N second DEMUX circuit includes b1 second switches, input terminals of the b1 second switches being electrically connected to the second signal input terminal, an output terminal of each of the b1 second switches being electrically connected to one of the b1 second signal output terminals, and control terminals of the b1 second switches being electrically connected to b1 control signal lines of the a1 control signal lines respectively. Each second DEMUX circuit of the N second DEMUX circuits includes c1 dummy switches, input terminals of the c1 dummy switches being electrically connected to the second signal input terminal, control terminals of the c1 dummy switches being electrically connected to c1 control signal lines of the a1 control signal lines respectively, where c1 is a positive integer, and $c1=a1-b1$. The method includes sequentially providing a first electrical signal to the a1 control signal lines during a frame period, where the first electrical signal controls turning on the a1 first switches, the b1 second switches, and the c1 dummy switches; providing a data signal to the first signal input terminal when one of the a1 first switches is turned on; providing a data signal to the second signal input terminal when one of the b1 second switches is turned on; and providing a data signal at a previous moment or a high-voltage signal to the second signal input terminal when one of the c1 dummy switches is turned on.

In still another aspect, an embodiment of the present disclosure provides a display device including the display panel described above.

BRIEF DESCRIPTION OF DRAWINGS

In order to more clearly illustrate technical solutions in embodiments of the present disclosure, the accompanying drawings used in the embodiments are briefly introduced as follows. It should be noted that the drawings described as follows are merely part of the embodiments of the present disclosure, other drawings can also be acquired by those skilled in the art without paying creative efforts.

DETAILED DESCRIPTION OF EMBODIMENTS

For better illustrating technical solutions of the present disclosure, embodiments of the present disclosure will be described in detail as follows with reference to the accompanying drawings.

It should be noted that, the described embodiments are merely exemplary embodiments of the present disclosure, which shall not be interpreted as providing limitations to the present disclosure. All other embodiments obtained by those skilled in the art without creative efforts according to the embodiments of the present disclosure fall into the scope of the present disclosure.

The terms used in the embodiments of the present disclosure are merely for the purpose of describing embodiments but not intended to limit the present disclosure. Unless otherwise noted in the context, the expressions "a", "an", "the" and "said" in singular form used in the embodiments and appended claims of the present disclosure are also intended to represent plural form expressions thereof.

The term "and/or" used herein is merely an association relationship describing associated objects, indicating that there can be three relationships, for example, A and/or B can indicate three cases, i.e., A alone, A and B, B alone. In addition, the character "/" herein generally indicates that the related objects before and after the character are in an "or" relationship.

In the description of this specification, it should be understood that the terms "substantially", "basically", "approximately", "about", "almost", and "roughly" described in the claims and embodiments of the present disclosure indicates a value that can be generally accepted within a reasonable process operation range or tolerance range, rather than an exact value.

Figure 1:
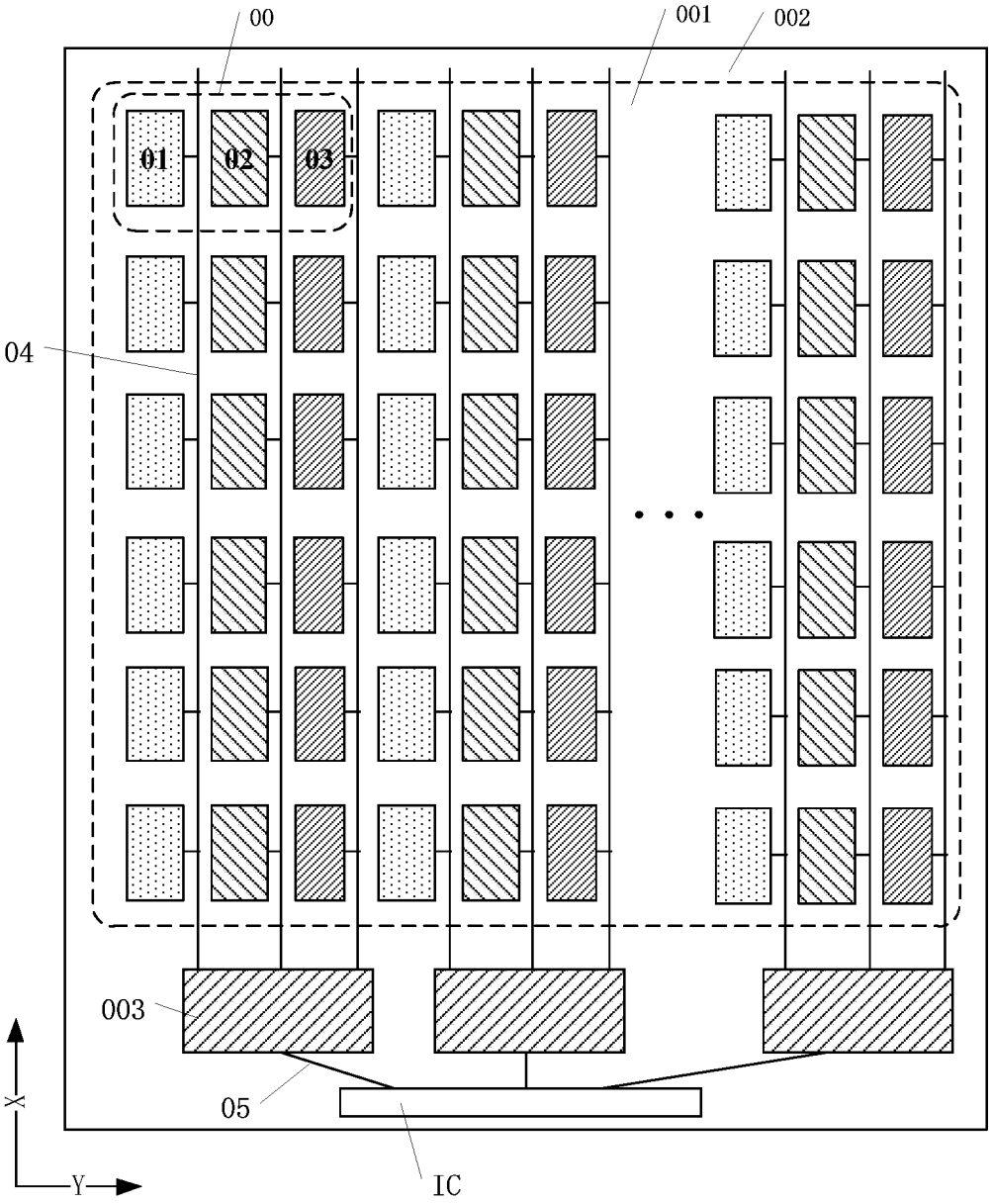
FIG. 1 is a schematic diagram of a display panel provided in the related art.
Figure 2:
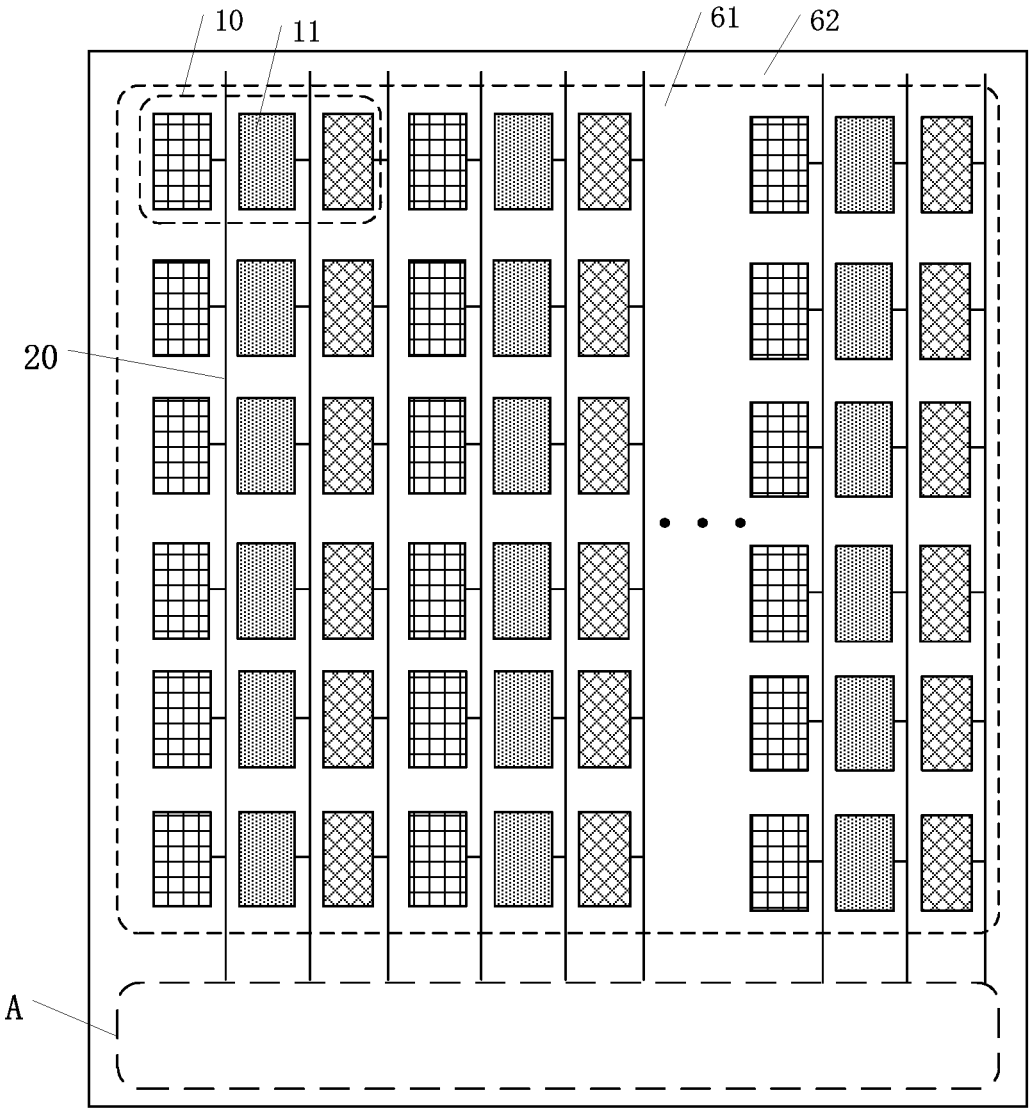
FIG. 2 is a schematic diagram of a display panel according to some embodiments of the present disclosure.
Figure 3:
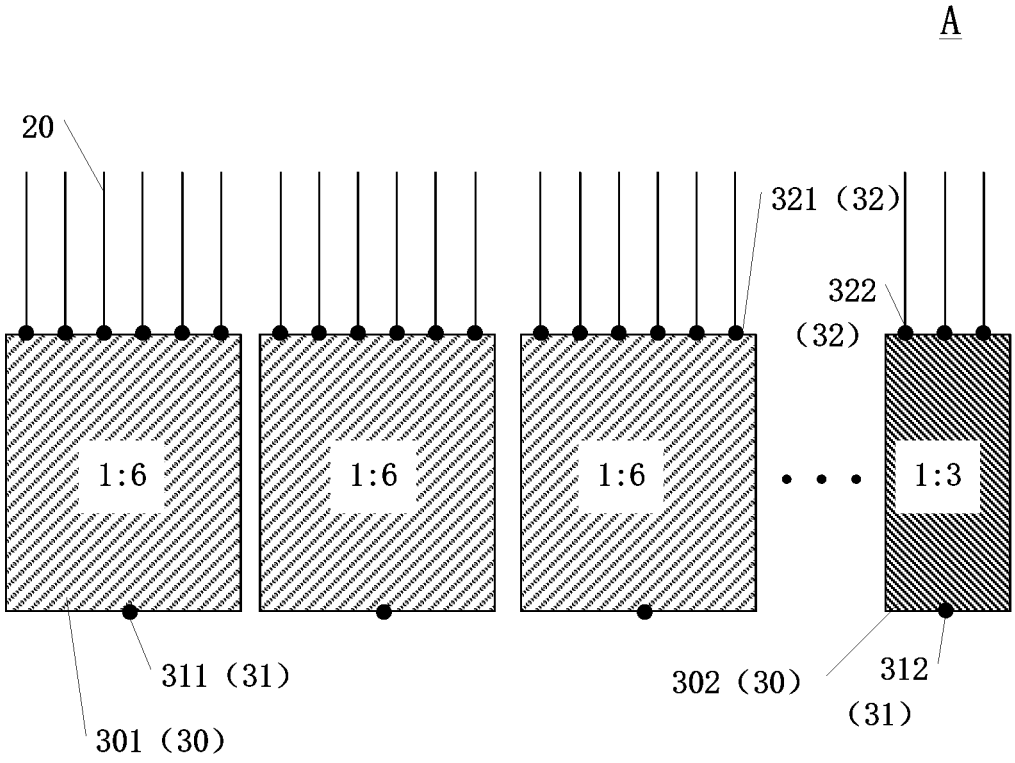
FIG. 3 is a schematic diagram of the area A shown in FIG. 2.

FIG. 2 is a schematic diagram of a display panel according to an embodiment of the present disclosure; and FIG. 3 is a schematic diagram of an area A shown in FIG. 2.

With reference to FIG. 2 and FIG. 3, an embodiment of the present disclosure provides a display panel having a display area 61 and a non-display area 62. The display panel includes pixels 10 arranged in H columns in the display area 61, H*x data lines 20 arranged in the display area 61, and multiple DEMUX circuits 30 arranged in the non-display area 61. Each pixel 10 includes x sub-pixels 11, and the data line 20 is electrically connected to the sub-pixel 11.

The DEMUX circuit 30 includes a signal input terminal 31 and a signal output terminal 32, and the signal output terminal 32 is electrically connected to the data line 20.

The multiple DEMUX circuits 30 include M first DEMUX circuits 301 and N second DEMUX circuits 302.

The first DEMUX circuit 301 includes a first signal input terminal 311 and a1 first signal output terminals 321.

The second DEMUX circuit 302 includes a second signal input terminal 312 and b1 second signal output terminals 322.

$H*x=M*a1+N*b1$, H, x, M, N, a1, and b1 are all positive integers, $M>N$, $a1>2$, $b1\geq 2$, $a1>b1$, and (M+N) is an even number.

In an embodiment, an example in which x=3 is illustrated, that is, each pixel 10 includes three sub-pixels 11. In other embodiments, x can be 2, 4, 6, or another integer, which is not limited in the present disclosure.

The a1 can be a positive integer equal to or greater than 3, and the b1 can be a positive integer equal to or greater than 2. In an embodiment, an example in which a1=6 and b1=3 is illustrated, that is, a ratio of the number of input terminals of the first DEMUX circuit 301 to the number of output terminals of the first DEMUX circuit 301 is 1:6, and a ratio of the number of input terminals of the second DEMUX circuit 302 to the number of output terminals of the second DEMUX circuit 302 is 1:3.

In the display panel provided in the embodiment, the multiple DEMUX circuits 30 are arranged in the non-display area, and the DEMUX circuits 30 can output an electrical signal supplied by the input terminal via different output terminals in different periods. A circuit structure of the DEMUX circuit can refer to the technology in the related art, which will not be limited in the present disclosure.

The DEMUX circuits 30 include M first DEMUX circuits 301 and N second DEMUX circuits 302. The number of the first DEMUX circuits 301 is greater than the number of the second DEMUX circuits 302, and the number of the first signal output terminals 321 of a single first DEMUX circuit 301 is greater than the number of the second signal output terminals 322 of a single second DEMUX circuit 302. In an example, the first DEMUX circuit 301 is a main DEMUX circuit in the display panel. While allocating the DEMUX circuits of the display panel, the number of remaining data lines is not an integral multiple of a1 after M first DEMUX circuits 301 are arranged, and thus it is impossible to arrange an integral number of first DEMUX circuits 301, so N second DEMUX circuits 302 are arranged, and the number of remaining data lines can be exactly divided by b1. Meanwhile, (M+N) is an even number, which facilitates a symmetry arrangement of the number of the DEMUX circuits. In the display panel provided in the embodiment, for a display panel with a special number of data lines, a solution for arranging the DEMUX circuits is provided, and the DEMUX circuits can be symmetrically arranged in terms of number, which can avoid a risk of uneven display and improve a display quality.

In the embodiment, an example in which the display panel has a rectangle shape is illustrated. The display panel can also have a circle, an oval, a rounded rectangle, or other non-rectangular shape, or even a special shape. The shape of the display panel is not limited in the embodiments of the present disclosure.

Figure 4:
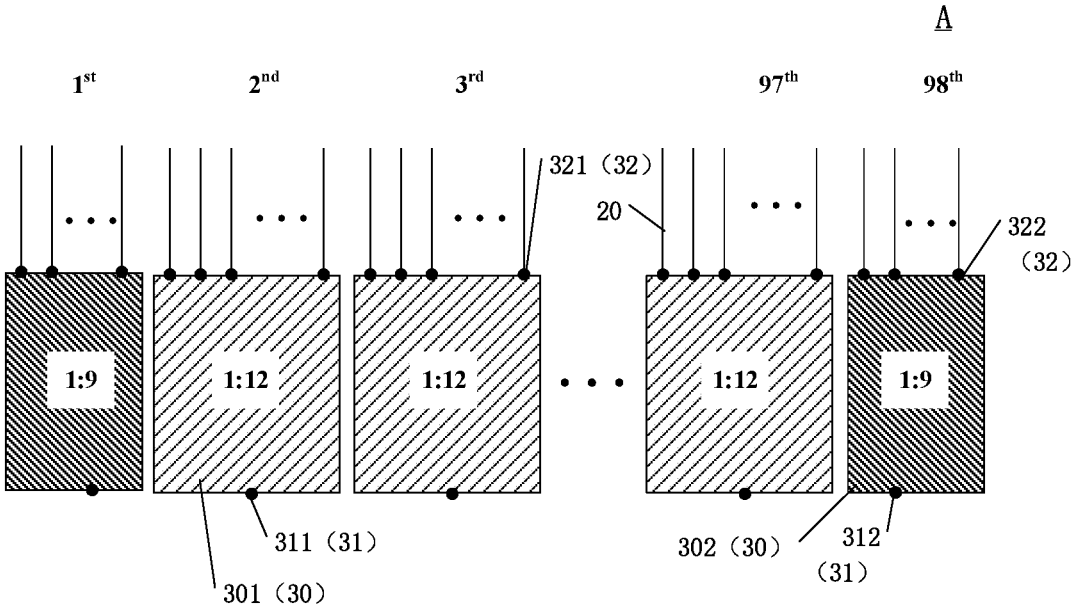
FIG. 4 is another schematic diagram of the area A shown in FIG. 2.

FIG. 4 is another schematic diagram of an area A shown in FIG. 2.

In some embodiments, the DEMUX circuits 30 are sequentially arranged as a $1^{st}$ DEMUX circuit 30 to a $(M+N)^{th}$ DEMUX circuit 30, and the N second DEMUX circuits 302 include the Pt DEMUX circuit to an $n1^{th}$ DEMUX circuit of the DEMUX circuits 30 that are sequentially arranged, and a $(M+N-n2)^{th}$ DEMUX circuit to the $(M+N)^{th}$ DEMUX circuit of the DEMUX circuits 30 that are sequentially arranged, where, n1+n2=N and both n1 and n2 are positive integers.

In the display panel provided in this embodiment, at least one second DEMUX circuit 302 is arranged at a headmost position of the DEMUX circuits, and at least one another second DEMUX circuit 302 is arranged at an end position of the DEMUX circuits, which is beneficial to a load balancing for the data lines. And it is avoided to set the second DEMUX circuits 302 at a middle position, which avoids affecting a load of a date line electrically connected to the first DEMUX circuit 301 adjacent thereto and avoids the uneven display.

In other embodiments, the second DEMUX circuits can be arranged at the middle position, in which case an IC (chip) is provided to perform corresponding operations on data signals. In this way, the uneven display caused by the load difference can be avoided.

In order to clearly illustrate the technical solution of the embodiment, each parameter with a numerical value is described in the following as an example.

In an embodiment according to FIG. 4, an example is described by taking the following values, in which the number H*x of data lines is 390*3, the number x of sub-pixels of each pixel is 3, the number a1 of the first signal output terminals 321 of the first DEMUX circuit 301 is 12, and the number b1 of the second signal output terminals 322 of the second DEMUX circuit 302 is 9.

When setting the DEMUX circuit, if the DEMUX circuits only include the first DEMUX circuit with a ratio of 1:12, 390*3/12=97.5, that is, 390*3 cannot be exactly divided by 12. According to a technical solution provided by an embodiment of the present disclosure, it can be set that 390*3=96*12+2*9, that is, the number M of the first DEMUX circuits is 96, and the number N of the second DEMUX circuits 302 is 2. Correspondingly, (M+N)=(96+2)=98.

The DEMUX circuits 30 are arranged as a $1^{st}$ DEMUX circuit to a $98^{th}$ DEMUX circuit. The two second DEMUX circuits 302 include the $1^{st}$ DEMUX circuit and the $98^{th}$ DEMUX circuit of the DEMUX circuit 302.

Figure 5:
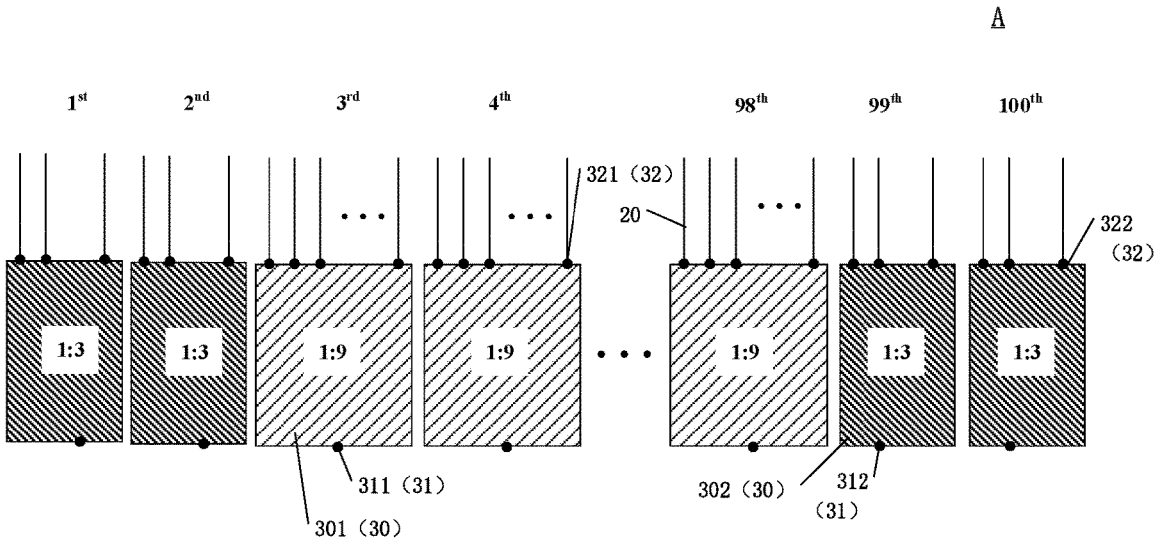
FIG. 5 is still another schematic diagram of the area A shown in FIG. 2.

FIG. 5 is still another schematic diagram of an area A shown in FIG. 2.

In an embodiment according to FIG. 5, an example is described by taking the following values, in which the number H*x of data lines is 292*3, the number x of sub-pixels of each pixel is 3, the number a1 of the first signal output terminals 321 of the first DEMUX circuit 301 is 9, and the number b1 of the second signal output terminals 322 of the second DEMUX circuit 302 is 3.

When setting the DEMUX circuit, if the DEMUX circuits only include the first DEMUX circuit with a ratio of 1:9, 292*3/12=97.33, in which case 292*3 cannot be exactly divided by 12. According to a technical solution provided by an embodiment of the present disclosure, it can be set that 390*3=96*9+3*4, that is, the number M of the first DEMUX circuits is 96, and the number N of the second DEMUX circuits 302 is 4. Correspondingly, (M+N)=(96+4)=100.

The DEMUX circuits 30 are arranged as a $1^{st}$ DEMUX circuit to a $100^{th}$ DEMUX circuit. Among the four second DEMUX circuits 302, two second DEMUX circuits 302 include $1^{st}$ to $2^{nd}$ DEMUX circuits of the DEMUX circuits 30, and the other two second DEMUX circuits 302 include $99^{th}$ to $100^{th}$ DEMUX circuits of the DEMUX circuits 30.

In the embodiment according to FIG. 5, an example in which n1=2 and n2=2 is illustrated. In other embodiments, it is can be set that n1=1 and n2=3, it is also can be set that n1=3 and n2=1. If N is an even number, setting n1=n2 is beneficial for the DEMUX circuit to be arranged symmetrically, thereby being beneficial to reduce the load difference between the data lines and thus avoiding or ameliorating the uneven display.

Figure 6:
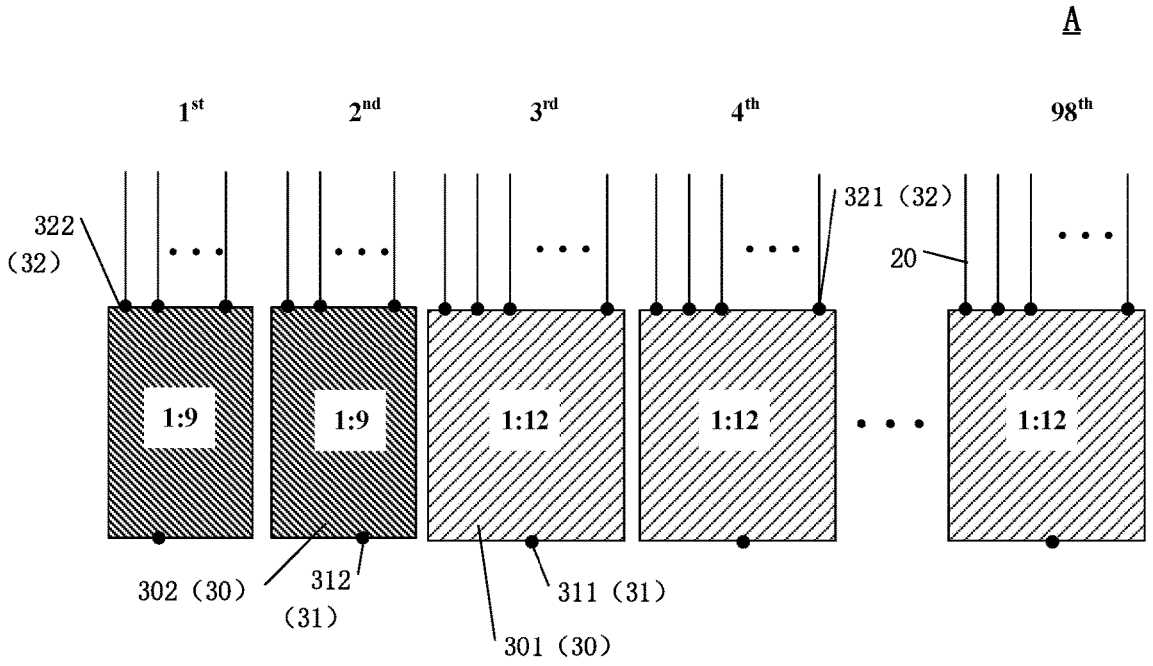
FIG. 6 is still another schematic diagram of the area A shown in FIG. 2.

FIG. 6 is still another schematic diagram of an area A shown in FIG. 2.

In some embodiments, as shown in FIG. 6, the DEMUX circuits 30 are arranged as a $1^{st}$ DEMUX circuit 30 to a $(M+N)^{th}$ DEMUX circuit 30, and the N second DEMUX circuits 302 include the $1^{st}$ DEMUX circuit to an $N^{th}$ DEMUX circuit of the DEMUX circuits 30 that are sequentially arranged or a $(M+1)^{th}$ DEMUX circuit to a $(M+N)^{th}$ DEMUX circuit of the DEMUX circuits 30 that are sequentially arranged.

In the display panel provided in an embodiment, at least one second DEMUX circuit 302 is arranged at the headmost position of the DEMUX circuits and at least one another second DEMUX circuit 302 is arranged at the end position of the DEMUX circuits, which is beneficial to the load balancing for the data lines. And it is avoided to set the second DEMUX circuits 302 at the middle position, which avoids affecting the load of the date line electrically connected to the first DEMUX circuit 301 adjacent thereto and avoids the uneven display.

In other embodiments, the second DEMUX circuits can be arranged at the middle position, in which case an IC is provided to perform corresponding operations on the data signal. In this way, the uneven display caused by the load difference can be avoided.

In order to clearly illustrate the technical solution of the embodiment, each parameter with a numerical value is described in the following as an example.

In an embodiment according to FIG. 6, an example is described by taking the following values, in which the number H*x of data lines is 390*3, the number x of sub-pixels of each pixel is 3, the number a1 of the first signal output terminals 321 of the first DEMUX circuit 301 is 12, and the number b1 of the second signal output terminals 322 of the second DEMUX circuit 302 is 9.

When setting the DEMUX circuit, if the DEMUX circuits only include the first DEMUX circuit with the ratio of 1:12, then 390*3/12=97.5, in which case 390*3 cannot be exactly divided by 12. According to a technical solution provided by an embodiment of the present disclosure, it can be set that 390*3=96*12+2*9, that is, the number M of the first DEMUX circuits is 96, and the number N of the second DEMUX circuits 302 is 2. Correspondingly, (M+N)=(96+2)=98.

Figure 7:
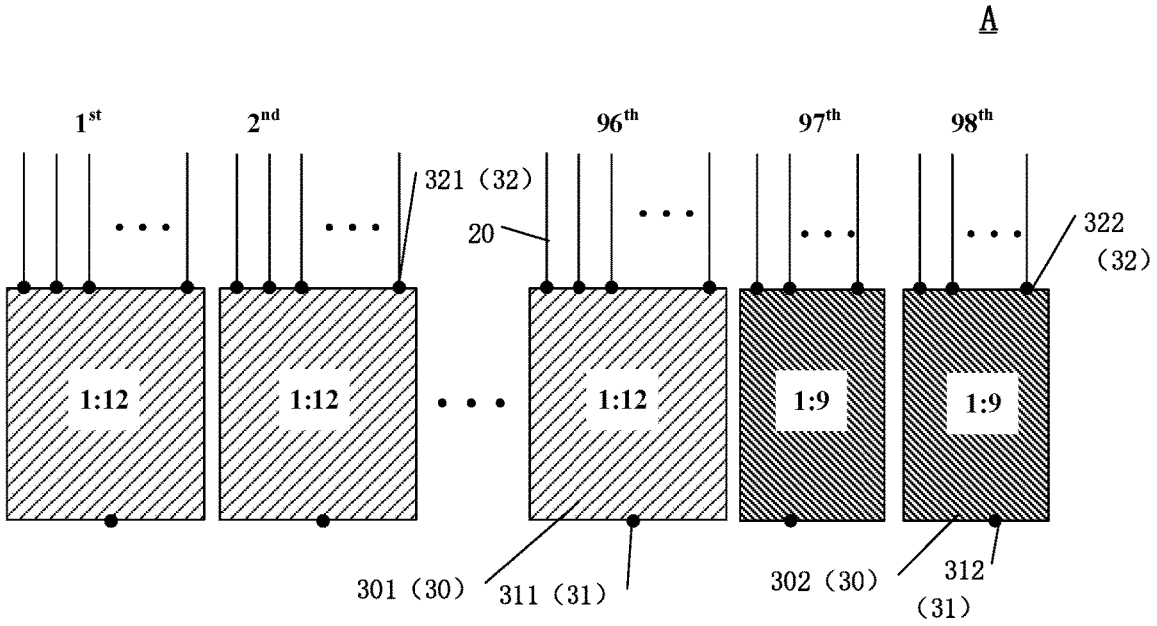
FIG. 7 is still another schematic diagram of the an area A shown in FIG. 2.

The DEMUX circuits 30 can be sequentially arranged as a $1^{st}$ DEMUX circuit to a $98^{th}$ DEMUX circuit. The two second DEMUX circuits 302 include the $1^{st}$ DEMUX circuit and the $2^{nd}$ DEMUX circuit of the DEMUX circuits 30, or as shown in FIG. 7, the two second DEMUX circuits 302 include the $97^{th}$ DEMUX circuit and the 98nd DEMUX circuit of the DEMUX circuits 30.

Figure 8:
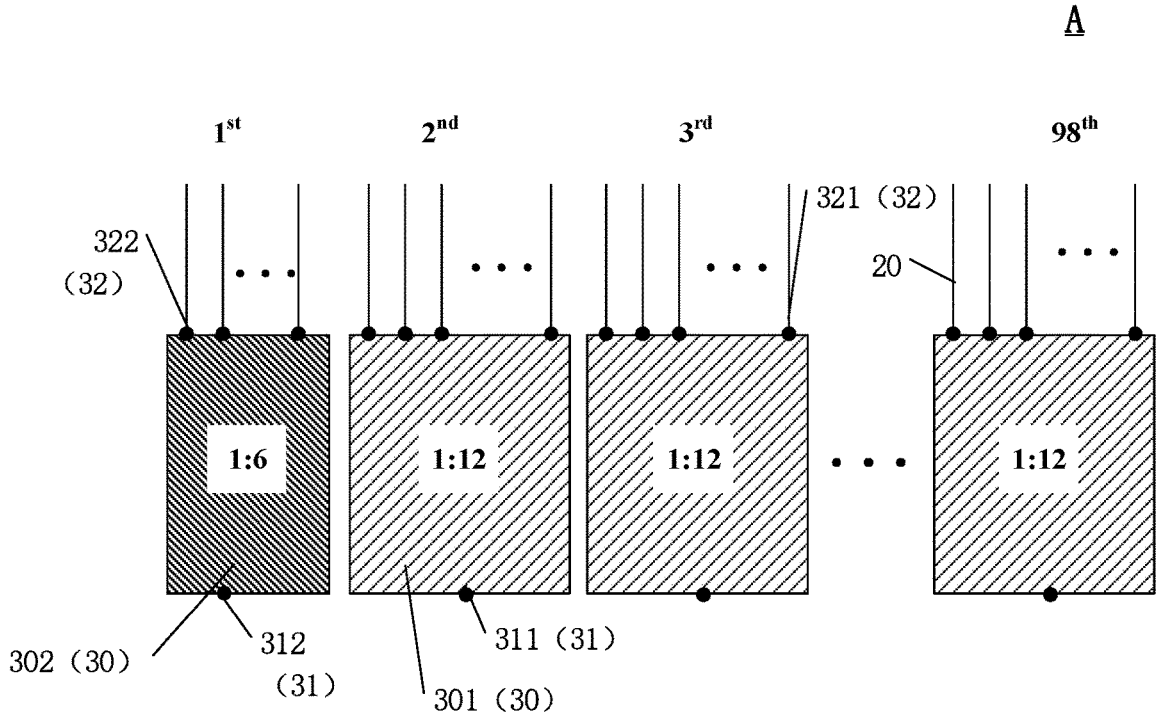
FIG. 8 is still another schematic diagram of the area A shown in FIG. 2.
Figure 9:
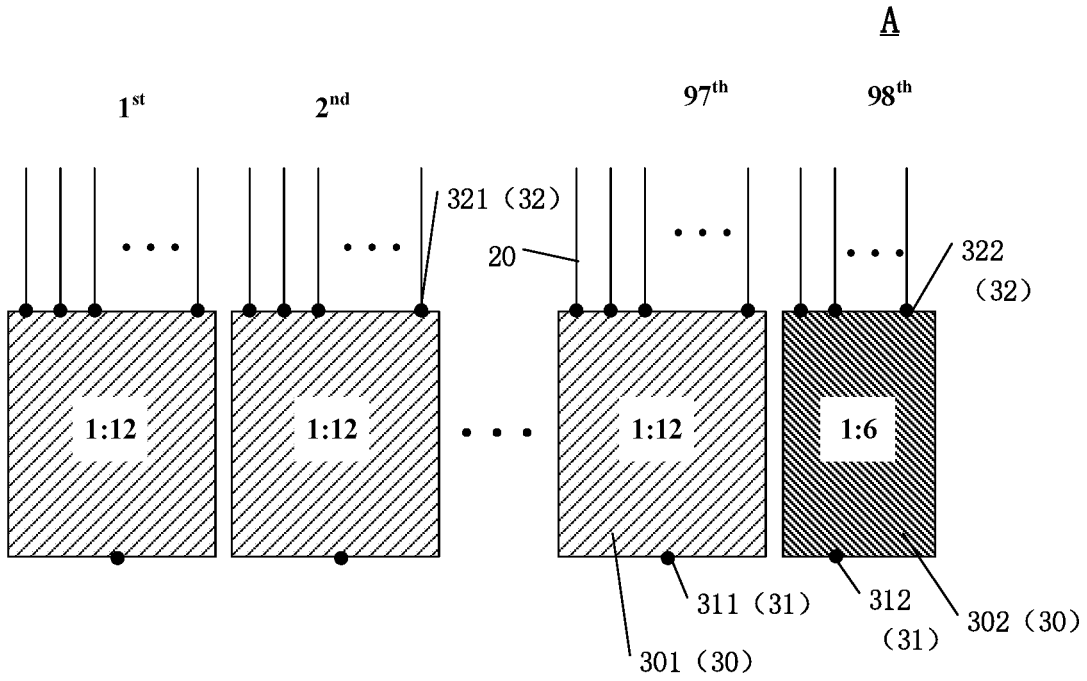
FIG. 9 is still another schematic diagram of the area A shown in FIG. 2.

FIG. 8 is still another schematic diagram of an area A shown in FIG. 2, and FIG. 9 is still another schematic diagram of an area A shown in FIG. 2.

In some embodiments, N=1. That is, the number of the second DEMUX circuit 302 is 1, and the second DEMUX circuit 302 is arranged at the headmost position or at the end position. The smaller the number of the second DEMUX circuits is, the more beneficial it is to the load balance of the data lines in the display panel, and thus the more beneficial it is to an even display.

Some embodiments according to FIG. 8 and FIG. 9 are described by taking the following values as an example, in which the number H*x of data lines is 390*3, the number x of sub-pixels of each pixel is 3, the number a1 of the first signal output terminals 321 of the first DEMUX circuit 301 is 12, and the number b1 of the second signal output terminals 322 of the second DEMUX circuit 302 is 6.

When setting the DEMUX circuit, if DEMUX circuits only include the first DEMUX circuit with the ratio of 1:12, 390*3/12=97.5, in which case 390*3 cannot be exactly divided by 12. According to a technical solution provided by an embodiment of the present disclosure, it can be set that 390*3=97*12+1*6, that is, the number M of the first DEMUX circuits is 97, and the number N of the second DEMUX circuits 302 is 1. Correspondingly, (M+N)=(97+1)=98.

The DEMUX circuits 30 are arranged as a $1^{st}$ DEMUX circuit to a $98^{th}$ DEMUX circuit. With reference to FIG. 8, the one second DEMUX circuit 302 is the $1^{st}$ DEMUX circuit of DEMUX circuits 30; or with reference to FIG. 9, the one second DEMUX circuit 302 is the $98^{th}$ DEMUX circuit of DEMUX circuits 30.

In an example, the number N of the second DEMUX circuits 302 can be set according to the following rule: if a remainder of (H*x)/a1 is an odd number, N=1; if the remainder of (H*x)/a1 is an even number, N=1 or N=2. For example, in the display panel shown in FIG. 8 or FIG. 9, a quotient obtained by dividing 390*3 by 12 is 97 and a corresponding remainder is 6. Since the remainder 6 is an even number, one second DEMUX circuit 302 or two second DEMUX circuits 302 with a ratio of 1:3 can be provided, which will not be illustrated with the accompanying drawings.

In an embodiment, setting that an integer quotient is C and a remainder is D when (H*x) is divided by a1, it can be set that N=1, in this case, the number b1 of the second signal output terminals 322 of the second DEMUX circuit 302 is D. In an embodiment, setting that an integer quotient is C and a remainder is D when (H*x) is divided by a1, if (a1+D) is an even number, is can be set that N=2, in this case, the number b1 of the second signal output terminals 322 of the second DEMUX circuit 302 is (a1+D)/2. In an embodiment, setting that an integer quotient is C and a remainder is D when (H*x) is divided by a1, if (a1+D) is an integral multiple of 3, it can be set that N=3, in this case, the number b1 of the second signal output terminals 322 of the second DEMUX circuit 302 is (a1+D)/3, and so on, provided that: H*x=M*a1+N*b1, H, x, M, N, a1, and b1 are all positive integers, and M>N, a1>2, b1≥2, a1>b1, and (M+N) is an even number.

Figure 10:
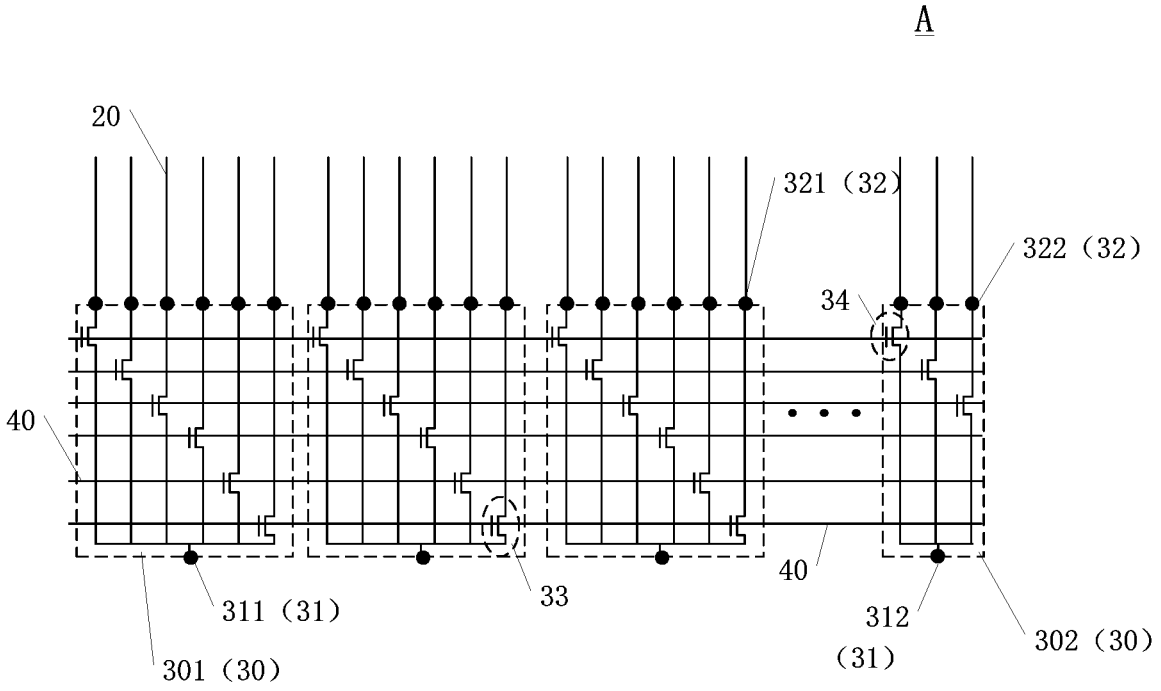
FIG. 10 is still another schematic diagram of the area A shown in FIG. 2.

FIG. 10, which is still another schematic diagram of an area A shown in FIG. 2.

In some embodiments, the display panel further includes a1 control signal lines 40 arranged in the non-display area 62.

The first DEMUX circuit 301 includes a1 first switches 33. Input terminals of the a1 first switches 33 each are electrically connected to the first signal input terminal 311, output terminals of the first switches 33 are electrically connected to the first signal output terminals 321, and control terminals of the a1 first switches 33 are electrically connected to a1 control signal lines 40 respectively.

The second DEMUX circuit 302 includes b1 second switches 34. Input terminals of the b1 second switches 34 each are electrically connected to the second signal input terminal 312, output terminals of the second switches 34 are electrically connected to the second signal output terminals 322, and control terminals of the b1 second switches 34 are electrically connected to b1 control signal lines 40 respectively.

The display panel provided in an embodiment provides circuit structures of the first DEMUX circuit 301 and the second DEMUX circuit 302.

In an embodiment according to FIG. 10, the following values are described as an example, in which the number a1 of the first signal output terminals 321 of the first DEMUX circuit 301 is 6, the number b1 of the second signal output terminals 322 of the second DEMUX circuit 302 is 3, and the number of the control signal lines 40 is also a1, i.e., 6.

In the embodiment, the first DEMUX circuits 301 and the second DEMUX circuits 302 share the control signal lines 40, so that the number of signal lines arranged in the non-display area can be reduced, thereby facilitating a narrow bezel design of the display panel. In an embodiment, the first DEMUX circuit 301 and the second DEMUX circuit 302 can be provided with independent control signal lines, thereby facilitating an independent control to the first DEMUX circuit 301 and the second DEMUX circuit 302, which will not be described one by one in this embodiment with accompanying drawings.

Figure 11:
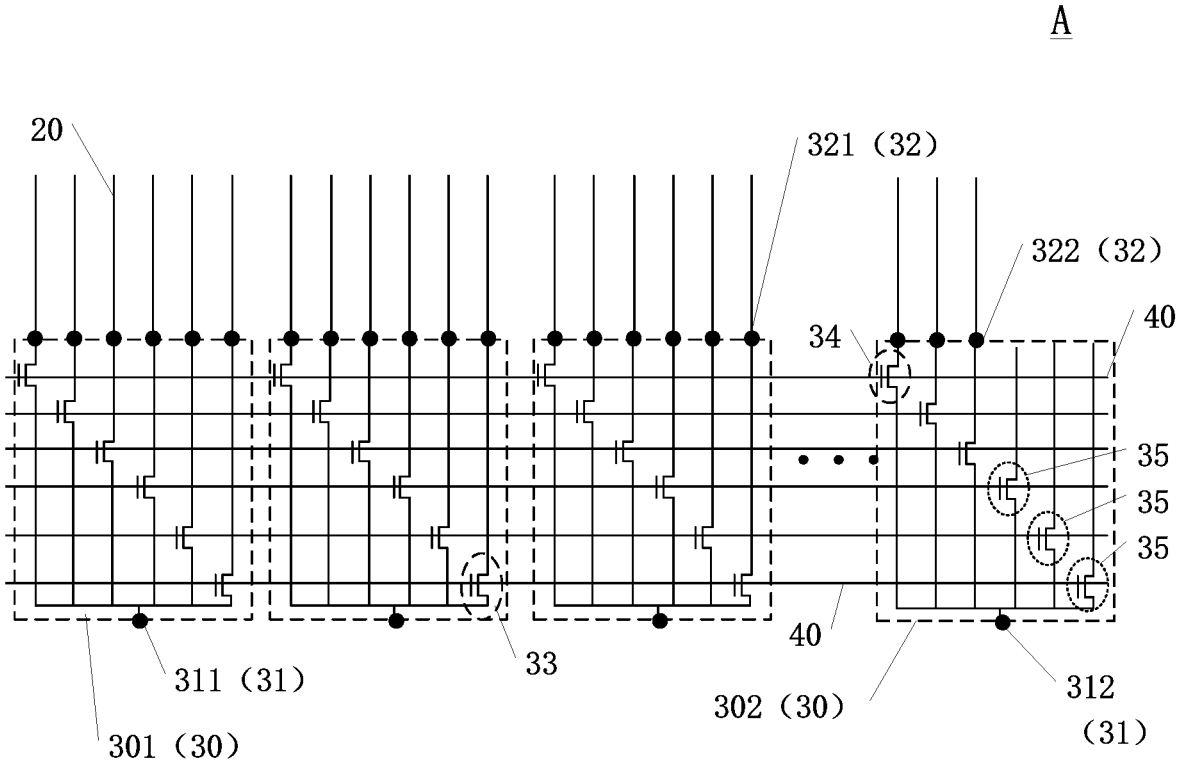
FIG. 11 is still another schematic diagram of the area A shown in FIG. 2.

FIG. 11 is still another schematic diagram of an area A shown in FIG. 2.

In some embodiments, the second DEMUX circuit 302 includes c1 dummy switches 35; For a same second DEMUX circuit 302, input terminals of the c1 dummy switches 35 are electrically connected to the second signal input terminal 312, control terminals of the c1 dummy switches 35 are electrically connected to c control signal lines 40, where c is a positive integer and c1=a1−b1.

In an embodiment, the number of switches of the first DEMUX circuit 301 is different from the number of switches of the second DEMUX circuit 302, e.g., the number of second switches of the second DEMUX circuit 302 being smaller than the number of first switches of the first DEMUX circuit 301. The dummy switches 35 are provided to supplement switches that the second DEMUX circuit 302 lacks relative to the first DEMUX circuit 301. That is, in the second DEMUX circuit 302, a sum of the number of the second switches 34 and the number of the dummy switches 35 is (b1+c1), and (b1+c1) is equal to the number a1 of the first switches 33 arranged in the first DEMUX circuit 301. The control terminals of switches of the second DEMUX circuit 302 are electrically connected to different control signal lines respectively.

Figure 12:
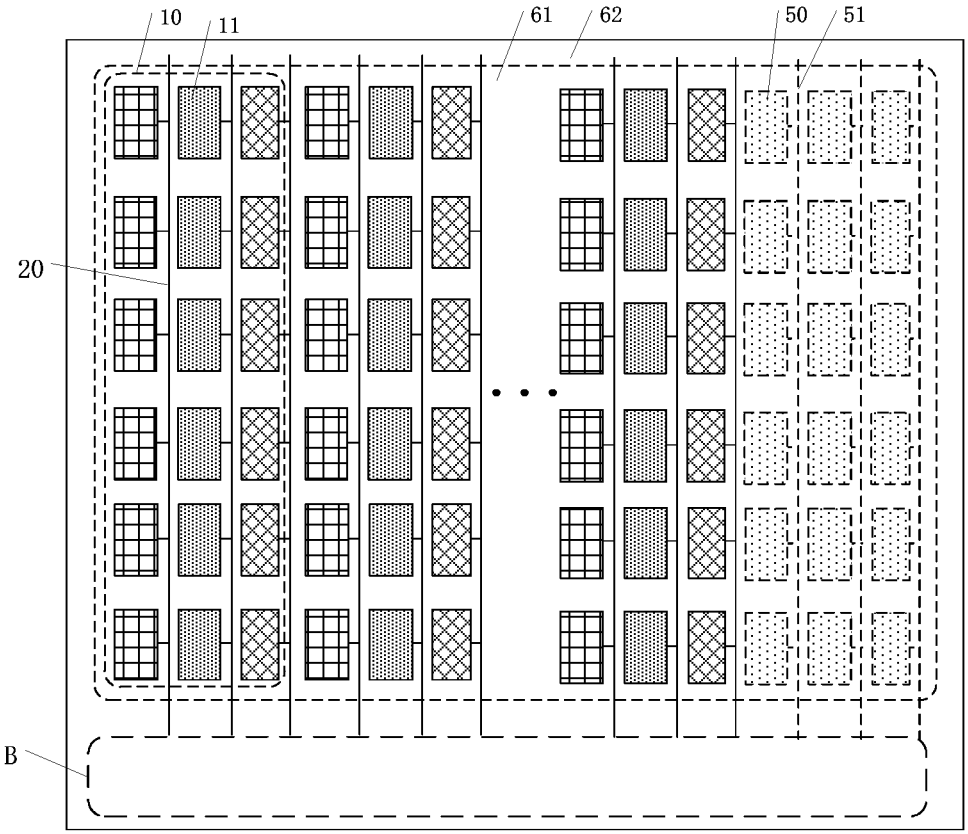
FIG. 12 is another schematic diagram of a display panel according to some embodiments of the present disclosure.
Figure 13:
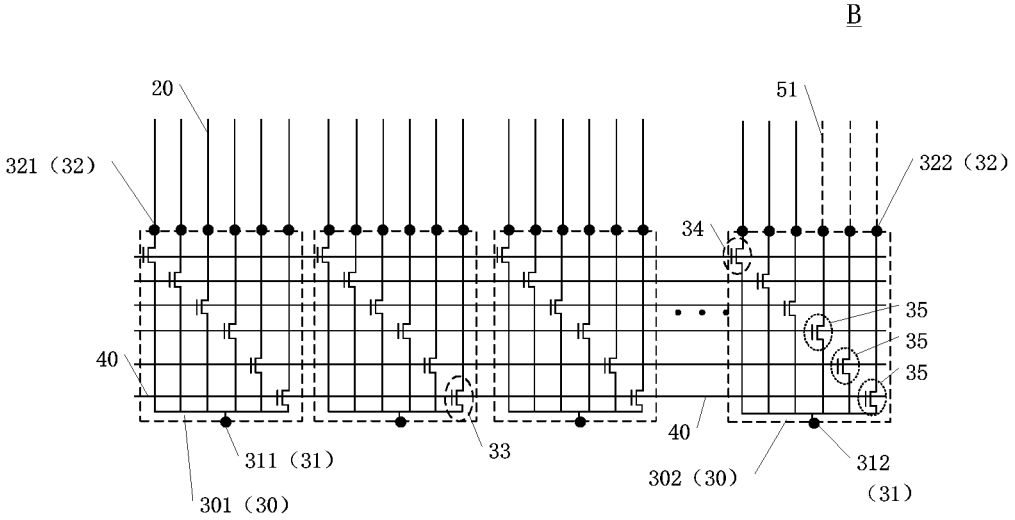
FIG. 13 is a schematic diagram of the area B shown in FIG. 12.

In an embodiment, the output terminal of the dummy switch 35 is floating, that is, the output terminal of the dummy switch 35 is not connected to a data line or any other signal line. FIG. 12 is another schematic diagram of display panel according to an embodiment of the present disclosure, and FIG. 13 is a schematic diagram of an area B shown in FIG. 12. In an embodiment, as shown in FIG. 12 and FIG. 13, the output terminal of the dummy switch is connected to a dummy data line.

In an embodiment, the display panel further includes dummy sub-pixel 50 arranged in c1*N columns and c1*N dummy data lines 51. The dummy data line 51 is electrically connected to the dummy sub-pixel 50. The output terminal of the dummy switch 35 is electrically connected to the dummy data line 51. The dummy sub-pixel 50 and the sub-pixel 11 can have a same shape and a same size, but the dummy sub-pixel 50 does not have a function of displaying images and does not receive an electrical signal for displaying. The dummy sub-pixels 50 and dummy data lines 51 are provided in the display panel in the embodiment, thereby facilitating a symmetry of the display panel in the structure, moreover, the second DEMUX circuit 302 and the first DEMUX circuit 301 have similar structures.

Figure 14:
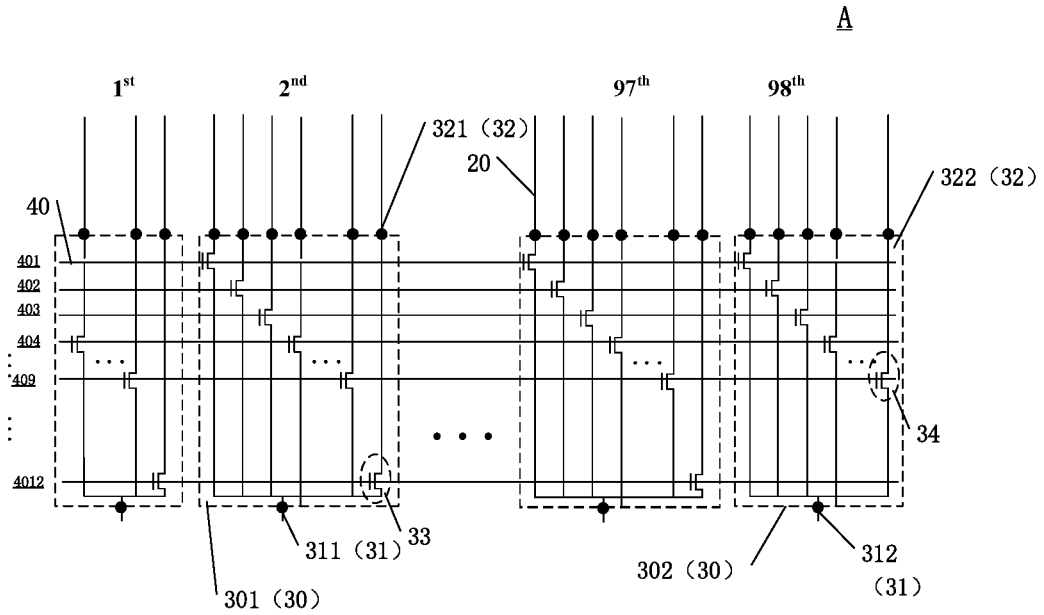
FIG. 14 is still another schematic diagram of the area A shown in FIG. 2.

FIG. 14 is illustrated based on FIG. 4, and FIG. 14 is still another schematic diagram of an area A shown in FIG. 2.

In some embodiments, as shown in FIG. 4 and FIG. 14, the display panel further includes a1 control signal lines 40 arranged in the non-display area 62. The first DEMUX circuit 301 includes a1 first switches 33. Input terminals of the a1 first switches 33 each are electrically connected to the first signal input terminal 311, output terminals of the first switches 33 are electrically connected to the first signal output terminals 321, and control terminals of the first switches 33 are electrically connected to a1 control signal lines 40 respectively. The second DEMUX circuit 302 includes b1 second switches 34. Input terminals of the b1 second switches 34 each are electrically connected to the second signal input terminal 312, output terminals of the second switches 34 are electrically connected to the second signal output terminals 322, and control terminals of the b1 second switches 34 are electrically connected to b1 control signal lines 40. The control terminals of the b1 second switches 34 of each of the $1^{st}$ DEMUX circuit to the $n1^{th}$ DEMUX circuit of the DEMUX circuits 30 are electrically connected to a $(a1\text{-}b1)^{th}$ control signal line to an $a1^{th}$ control signal line. The control terminals of the b1 second switches 34 of each of the $(M+N-n2)^{th}$ DEMUX circuit to the $(M+N)^{th}$ DEMUX circuit of the DEMUX circuits 30 are electrically connected to a $1^{st}$ control signal line to a $b1^{th}$ control signal line.

In an embodiment, each parameter is described in the following with a specific numerical value as an example, in which the number M of the first DEMUX circuits is 96 and the number N of the second DEMUX circuits 302 is 2. And n1=n2=1. The number a1 of the first signal output terminals 321 of the first DEMUX circuit 301 is 12, and the number b1 of the second signal output terminals 322 of the second DEMUX circuit 302 is 9. Correspondingly, (M+N)=(96+2)=98. The number of the control signal lines 40 is 12, and the twelve control signal lines 40 are arranged as a $1^{st}$ control signal line 401 to a $12^{th}$ control signal line 4012.

For the second DEMUX circuit 302 arranged at the headmost position, taking the $1^{st}$ DEMUX circuit shown in FIG. 14 as an example, control terminals of nine second switches 34 are electrically connected to a $4^{th}$ control signal line 404 to a $12^{th}$ control signal line 4012 of the control signal lines 40. When the display panel operates, the $1^{st}$ DEMUX circuit does not transmit a valid data signal for displaying in a process of scanning the $1^{st}$ controlling signal line 401 to the 3rd control signal line 403, and similar to other DEMUX circuits, the $1^{st}$ DEMUX circuit transmits a valid data signal for displaying in a process of scanning the $4^{th}$ control signal line 404 to the $12^{th}$ control signal line 4012. In this way, it is beneficial to simplify complexity of each control signal in the display panel and to simplify an operation of the IC.

For the second DEMUX circuit 302 arranged at the end position, taking the 98th DEMUX circuit shown in FIG. 14 as an example, control terminals of nine second switches 34 are electrically connected to a 1st control signal line 401 to a 9th control signal line 409 of the control signal lines 40. When the display panel operates, the $98^{th}$ DEMUX circuit transmits a valid data signal for displaying like other DEMUX circuit in a process of scanning the $1^{st}$ control signal line 401 to the $9^{th}$ control signal line 409, and does not transmit a valid data signal for displaying in a process of scanning the $10^{th}$ control signal line 4010 to the $12^{th}$ control signal line 4012. In this way, it is be beneficial to simplify complexity of each control signal in the display panel and to simplify an operation of the IC.

Figure 15:
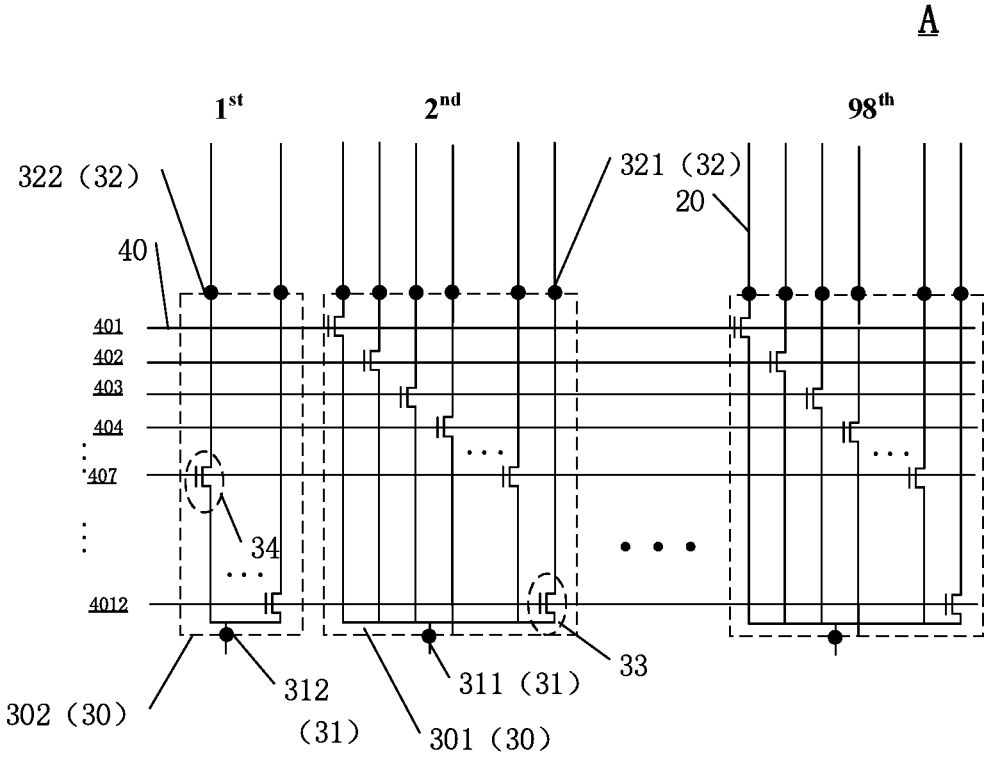
FIG. 15 is still another schematic diagram of the area A shown in FIG. 2.

FIG. 15 is illustrated based on FIG. 8, and FIG. 15 is still another schematic diagram of an area A shown in FIG. 2.

In some embodiments, as shown in FIG. 8 and FIG. 15, a1 control signal lines 40 are provided in the non-display area 62. The first DEMUX circuit 301 includes a1 first switches 33. Input terminals of the a1 first switches 33 are electrically connected to the first signal input terminal 311, output terminals of the first switches 33 are electrically connected to the first signal output terminals 321, and control terminals of the first switches 33 are electrically connected to a1 control signal lines 40. The second DEMUX circuit 302 includes b1 second switches 34. Input terminals of the b1 second switches 34 are electrically connected to the second signal input terminal 312, output terminals of the second switches 34 are electrically connected to the second signal output terminals 322, and control terminals of the second switches 34 are electrically connected to b1 control signal lines 40. A $1^{st}$ control signal line to an $a1^{th}$ clock signal of the a1 control signal lines 40 sequentially receive a clock signal within a frame. When the N second DEMUX circuits 302 include the 1st DEMUX circuit to the $N^{th}$ DEMUX circuit of the DEMUX circuits 30 that are sequentially arranged, control terminals of b1 second switches 34 are electrically connected to a $(a1-b1)^{th}$ control signal line to an $a1^{th}$ control signal line. When the N second DEMUX circuits 302 include the $(M+1)^{th}$ DEMUX circuit to the $(M+N)^{th}$ DEMUX circuit of the DEMUX circuits 30 that are sequentially arranged, the control terminals of the b1 second switches are electrically connected to a $1^{st}$ control signal line to a $b1^{th}$ control signal line of the a1 control signal lines.

Figure 16:
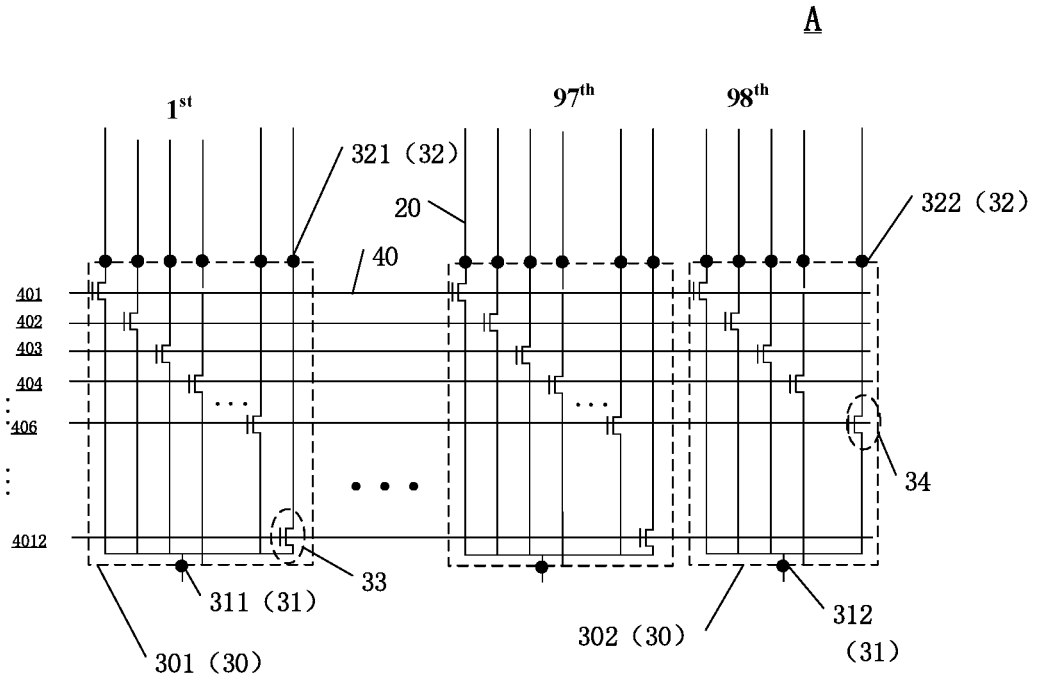
FIG. 16 is still another schematic diagram of the area A shown in FIG. 2.

FIG. 16 is still another schematic diagram of an area A shown in FIG. 2. In an embodiment, referring to FIG. 9 and FIG. 16, When the N second DEMUX circuits 302 include a $(M+1)^{th}$ DEMUX circuit to a $(M+N)^{th}$ DEMUX circuit of the DEMUX circuit 30, the control terminals of b1 second switches 34 are electrically connected to a 1st control signal line to a $b1^{th}$ control signal line.

In an embodiment, each parameter is described in the following with a specific numerical value as an example, in which the number M of the first DEMUX circuits is 97, and the number N of the second DEMUX circuits 302 is 1. The number a1 of the first signal output terminals 321 of the first DEMUX circuit 301 is 12, and the number b1 of the second signal output terminals 322 of the second DEMUX circuit 302 is 6. Correspondingly, (M+N)=(97+1)=98. The number of the control signal lines 40 is 12, and the 12 control signal lines 40 are a 1st control signal line 401 to a $12^{th}$ control signal line 4012.

For the second DEMUX circuit 302 arranged at the headmost position, taking the 1st DEMUX circuit shown in FIG. 15 as an example, the control terminals of six second switches 34 are electrically connected to a $7^{th}$ control signal line 407 to a $12^{th}$ control signal line 4012 of the control signal lines 40. When the display panel operates, the $1^{st}$ DEMUX circuit does not transmit a valid data signal for displaying during a process of scanning the $1^{st}$ control signal line 401 to the $6^{th}$ control signal line 406, and like other DEMUX circuits, the $1^{st}$ DEMUX circuit transmits a valid data signal for displaying during a process of scanning the $7^{th}$ control signal line 407 to the $12^{th}$ control signal line 4012. In this way, it will be beneficial to simplify complexity of each control signal in the display panel and to simplify an operation of the IC.

For the second DEMUX circuit 302 arranged at the last position, taking the $98^{th}$ DEMUX circuit shown in FIG. 16 as an example, control terminals of six second switches 34 are electrically connected to a $1^{st}$ control signal line 401 to a $6^{th}$ control signal line 406. When the display panel operates, like other DEMUX circuits, the $98^{th}$ DEMUX circuit transmits a valid data signal for displaying during a process of scanning the 1st control signal line 401 to the $6^{th}$ control signal line 406, and does not transmit a valid data signal for displaying during a process of scanning the $7^{th}$ control signal line 407 to the $12^{th}$ control signal line 4012 of the control signal lines 40. In this way, it will be beneficial to simplify complexity of each control signal in the display panel and to simplify an operation of the IC.

Figure 17:
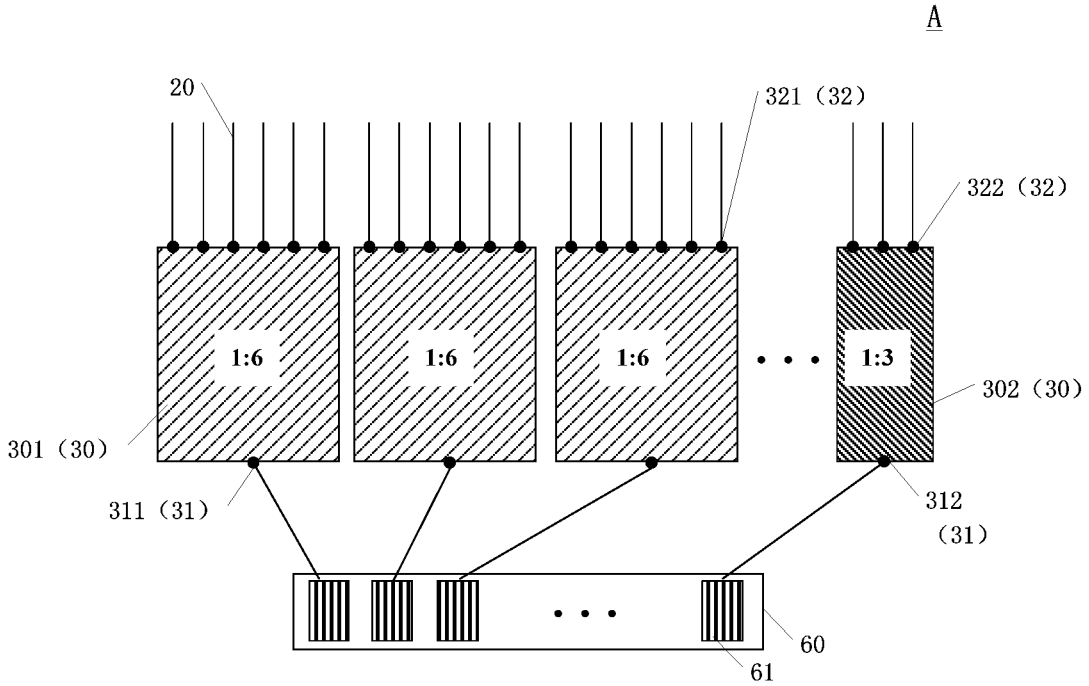
FIG. 17 is still another schematic diagram of the area A shown in FIG. 2.

FIG. 17 is still another schematic diagram of an area A shown in FIG. 2.

In some embodiments, as shown in FIG. 17, the non-display area 62 includes a binding area 60, multiple pads 61 are provided in the binding area 60, and the first signal input terminal 311 and the second signal input terminal 312 are electrically connected to the pads 61. In an embodiment, the pads 61 can be configured to bond the IC or an FPC, which will not be limited in the embodiment of the present disclosure.

In the display panel shown in the accompanying drawings of the present disclosure, a ratio of the number of input terminals of the DEMUX circuit to the number of output terminals of the DEMUX circuit is exemplarily described. It should be understood by those skilled in the art that the ratio of the number of input terminals of the DEMUX circuit and the number of the output terminals of the DEMUX circuit can be set according to actual needs of the actual panel, as long as it can meet requirements of the technical solution provided by the present disclosure, which will not be described one by one in the embodiment of the present disclosure.

An embodiment of the present disclosure further provides a method for driving the display panel provided by the embodiments of the present disclosure. In combination with FIG. 10, the method includes following steps:

sequentially providing a first electrical signal to a1 control signal lines 40 during a frame period, the first electrical signal controlling the first switch 33, the second switch 34, and the dummy switch 35 to be turned on;

providing a data signal to the first signal input terminal 311 when the first switch 33 is turned on;

providing a data signal to the second signal input terminal 312 when the second switch 34 is turned on; and providing a data signal at a previous moment or a high-voltage signal to the second signal input terminal 312 when the dummy switch 35 is turned on.

In the embodiment, since the second DEMUX circuit 302 is provided with the dummy switch 35, when driving the display panel to operate, although the dummy switch 35 is configured to not transmit a data signal to the sub-pixel for displaying, an electrical signal is still provided to the dummy switch 35, thereby reducing complexity of the driving signal of the IC of the display device and simplifying an operation of the IC. The electrical signal provided to the dummy switch 35 is the data signal at the previous moment or the high-voltage signal, which can avoid mutation or incorrect charging of the data signal caused by providing other data signals to affect normal display of the display panel.

In some embodiments of the present disclosure, a control unit can be connected in series in front of the dummy switch 35, and the control signal line is electrically connected to the control unit. The control signal of the control signal line is always a turn-off signal via the control unit, so as to control the dummy switch 35 to be always turned off, thereby avoid incorrect charging of the data signal from the IC to affect display of the display panel. A circuit structure of the control unit can be referred to the technology in the related art, which will not be further described in the embodiments of the present disclosure.

In some embodiments of the present disclosure, an individual control signal line can be provided to control the dummy switch 35, that is, in addition to a1 control signal lines, an individual dummy switch control signal line is provided only for controlling the dummy switch 35. When the display panel operates, the dummy switch control signal line is configured to control the dummy switch 35 to be always turned off, thereby avoid incorrect charging of the data signal of the IC to affect display of the display panel.

In the method provided by an embodiment of the present disclosure, the sub-pixel is charged via the data line in a direct-charging manner or a line-charging manner. The direct-charging manner refers to a way in which a scan signal of the sub-pixel and a corresponding switch of the DEMUX circuit are turned on at the same time, and the data signal is directly written into the sub-pixel via the DEMUX circuit. The line-charging manner refers to a manner in which the scan signal of the sub-pixel and the corresponding switch of the DEMUX circuit are turned on in a time division manner, that is, firstly, the switch of the DEMUX circuit is turned on and the data signal is written into the data line, then the scan signal of the sub-pixel is turned on and the data signal previously written into the data line is written into the sub-pixel.

Figure 18:
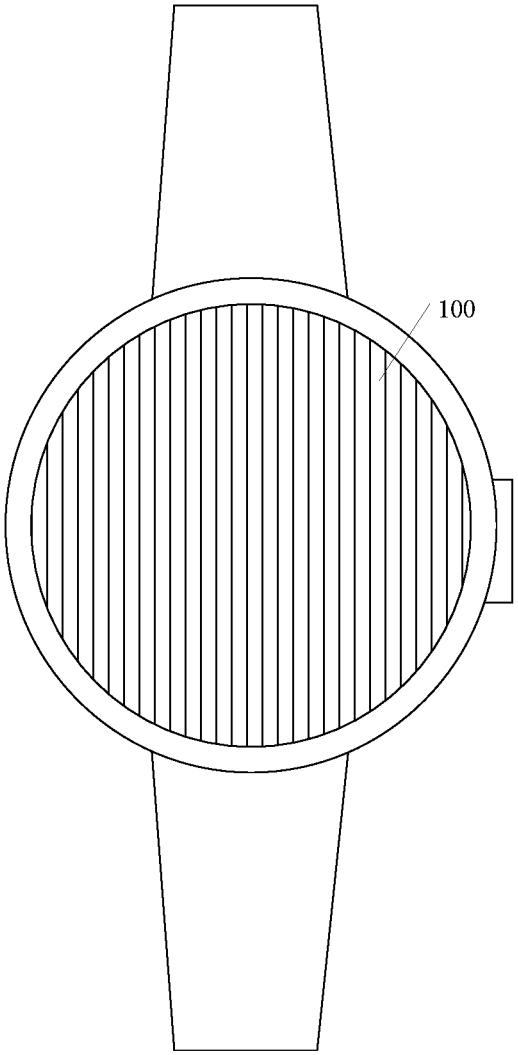
FIG. 18 is a schematic diagram of a display device according to some embodiments of the present disclosure.

An embodiment of the present disclosure further provides a display device, including the display panel provided by any one of the above-mentioned embodiments of the present disclosure. FIG. 18 is a schematic diagram of a display device according to an embodiment of the present disclosure, As shown in FIG. 18, an embodiment of the present disclosure further provides a display device, and the display device includes any one of the display panels 100 described above. A structure of the display panel has been described in details in the above embodiments, and will not be repeated herein. The display device shown in FIG. 18 is only illustrated as a round watch for an example, and the display device can be any electronic device with a display function, such as a mobile phone, a tablet computer, a notebook computer, an electronic paper book, or a television.

The above-described embodiments are merely exemplary embodiments of the present disclosure and are not intended to limit the present disclosure. Any modifications, equivalent substitutions and improvements made within the principle of the present disclosure shall fall into the protection scope of the present disclosure.

What is claimed is:

1. A display panel, comprising:

a display area and a non-display area;

pixels arranged in H columns in the display area, each of the pixels comprising x sub-pixels;

H*x data lines arranged in the display area and electrically connected to the sub-pixels of the pixels;

a plurality of DEMUX circuits arranged in the non-display area, each of the plurality of DEMUX circuits comprising signal output terminals, each of the signal output terminals being electrically connected to one of the H*x data lines, and the display panel comprising exactly H*x data lines; and a1 control signal lines arranged in the non-display area, wherein the plurality of DEMUX circuits comprises M first DEMUX circuits and N second DEMUX circuits, wherein each of the M first DEMUX circuits comprises a first signal input terminal and a1 first signal output terminals, wherein each of the N second DEMUX circuits comprises a second signal input terminal and b1 second signal output terminals, one of the M first DEMUX circuits shares one of the a1 control signal lines with one of the N second DEMUX circuits, and the display panel comprises exactly M+N DEMUX circuits;

where H*x=M*a1+N*b1, where H, x, M, N, a1, and b1 are positive integers, M>N, a1>2, b1≥2, a1>b1, and (M+N) is an even number;

wherein each of the M first DEMUX circuits comprises a1 first switches, wherein input terminals of the a1 first switches are electrically connected to the first signal input terminal, an output terminal of each of the a1 first switches is electrically connected to one of the a1 first signal output terminals, and control terminals of the a1 first switches are electrically connected to the a1 control signal lines respectively, and wherein each of the N second DEMUX circuits comprises b1 second switches, wherein input terminals of the b1 second switches are electrically connected to the second signal input terminal, wherein an output terminal of each of the b1 second switches is electrically connected to one of the b1 second signal output terminals, and wherein control terminals of the b1 second switches are electrically connected to b1 control signal lines of the a1 control signal lines respectively.

2. The display panel according to claim 1, wherein the plurality of DEMUX circuits is sequentially arranged as a $1^{st}$ DEMUX circuit to a $(M+N)^{th}$ DEMUX circuit; and the N second DEMUX circuits comprise the $1^{st}$ DEMUX circuit to an $n1^{th}$ DEMUX circuit of the plurality of DEMUX circuits that are sequentially arranged, and a $(M+N-n2)^{th}$ DEMUX circuit to the $(M+N)^{th}$ DEMUX circuit of the plurality of DEMUX circuits that are sequentially arranged, where n1+n2=N and both n1 and n2 are positive integers.

3. The display panel according to claim 2, wherein N is an even number, and n1=n2.

4. The display panel according to claim 1, wherein the plurality of DEMUX circuits is sequentially arranged as a $1^{st}$ DEMUX circuit to a $(M+N)^{th}$ DEMUX circuit; and the N second DEMUX circuits comprise the $1^{st}$ DEMUX circuit to an $N^{th}$ DEMUX circuit of the plurality of DEMUX circuits that are sequentially arranged or a $(M+1)^{th}$ DEMUX circuit to the $(M+N)^{th}$ DEMUX circuit of the plurality of DEMUX circuits are sequentially arranged.

5. The display panel according to claim 4, wherein N=1.

6. The display panel according to claim 1, wherein each second DEMUX circuit of the N second DEMUX circuits comprises c1 dummy switches, wherein input terminals of the c1 dummy switches are electrically connected to the second signal input terminal, wherein control terminals of the c1 dummy switches are electrically connected to c1 control signal lines of the a1 control signal lines respectively, where c1 is a positive integer, and c1=a1−b1.

7. The display panel according to claim 6, further comprising:

dummy sub-pixels arranged in c1*N columns; and c1*N dummy data lines;

wherein the c1*N dummy data lines are electrically connected to the dummy sub-pixels, and an output terminal of each of the c1 dummy switches is electrically connected to one of the c1*N dummy data lines.

8. The display panel according to claim 6, wherein an output terminal of each of the c1 dummy switches is floating.

9. The display panel according to claim 1, wherein if a remainder of (H*x)/a1 is an odd number, then N=1; and if the remainder of (H*x)/a1 is an even number, then N=1 or N=2.

10. The display panel according to claim 2, further comprising:

a1 control signal lines arranged in the non-display area;

wherein each of the M first DEMUX circuits comprises a1 first switches, wherein input terminals of the a1 first switches are electrically connected to the first signal input terminal, wherein an output terminal of each of the a1 first switches are electrically connected to one of the a1 first signal output terminals, and wherein control terminals of the a1 first switches are electrically connected to the a1 control signal lines respectively;

wherein each of the N second DEMUX circuits comprises b1 second switches, wherein input terminals of the b1 second switches are electrically connected to the second signal input terminal, wherein an output terminal of each of the b1 second switches are electrically connected to one of the b1 second signal output terminals, and wherein control terminals of the b1 second switches are electrically connected to the b1 control signal lines of the a1 control signal lines respectively;

wherein a $1^{st}$ control signal line to an $a1^{th}$ control signal line of the a1 control signal lines sequentially receive a clock signal during a frame;

wherein the control terminals of the b1 second switches of each of the $1^{st}$ DEMUX circuit to the $n1^{th}$ DEMUX circuit of the plurality of DEMUX circuits are electrically connected to a $(a1-b1)^{th}$ control signal line to an $a1^{th}$ control signal line of the a1 control signal lines; and wherein the control terminals of the b1 second switches of each of the $(M+N-n2)^{th}$ DEMUX circuit to the $(M+N)^{th}$ DEMUX circuit of the plurality of DEMUX circuits are electrically connected to a $1^{st}$ control signal line to a $b1^{th}$ control signal line of the a1 control signal lines.

11. The display panel according to claim 4, further comprising:

a1 control signal lines arranged in the non-display area, wherein each of the M first DEMUX circuits comprises a1 first switches, wherein input terminals of the a1 first switches are electrically connected to the first signal input terminal, wherein an output terminal of each of the a1 first switches is electrically connected to one of the a1 first signal output terminals, and wherein control terminals of the a1 first switches are electrically connected to the a1 control signal lines respectively;

wherein each of the N second DEMUX circuits comprises b1 second switches, wherein input terminals of the b1 second switches are electrically connected to the second signal input terminal, wherein an output terminal of each of the b1 second switches is electrically connected to one of the b1 second signal output terminals, and wherein control terminals of the b1 second switches are electrically connected to the b1 control signal lines of the a1 control signal lines respectively;

wherein a $1^{st}$ control signal line to an $a1^{th}$ control signal line of the a1 control signal lines sequentially receive a clock signal during a frame;

wherein the control terminals of the b1 second switches of the $1^{st}$ DEMUX circuit to the $N^{th}$ DEMUX circuit of the plurality of DEMUX circuits are electrically connected to a $(a1-b1)^{th}$ control signal line to an $a1^{th}$ control signal line of the a1 control signal lines; or wherein the control terminals of the b1 second switches of the $(M+1)^{th}$ DEMUX circuit to the $(M+N)^{th}$ DEMUX circuit of the plurality of DEMUX circuits are electrically connected to a control signal line to a $b1^{th}$ control signal line of the a1 control signal lines.

12. The display panel according to claim 1, wherein the non-display area further comprises a binding area; and wherein the display panel comprises:

a plurality of pads arranged in the binding area, wherein both the first signal input terminal and the second signal input terminal are electrically connected to the plurality of pads.

13. A method for driving a display panel, wherein the display panel comprises:

a display area and a non-display area;

pixels arranged in H columns in the display area, wherein each of the pixels comprising x sub-pixels;

H*x data lines arranged in the display area and electrically connected to the sub-pixels of the pixels; and a plurality of DEMUX circuits arranged in the non-display area, each of the plurality of DEMUX circuits comprising signal output terminals, each of the signal output terminals being electrically connected to one of the H*x data lines, and the display panel comprising exactly H*x data lines; and a1 control signal lines arranged in the non-display area;

wherein the plurality of DEMUX circuits comprises M first DEMUX circuits and N second DEMUX circuits, each of the M first DEMUX circuits comprising a first signal input terminal and a1 first signal output terminals, and wherein each of the N second DEMUX circuits comprises a second signal input terminal and b1 second signal output terminals, one of the M first DEMUX circuits shares one of the a1 control signal lines with one of the N second DEMUX circuits, and the display panel comprises exactly M+N DEMUX circuits;

where H*x=M*a1+N*b1, where H, x, M, N, a1, and b1 are positive integers, M>N, a1>2, b1≥2, a1>b1, and (M+N) is an even number;

wherein each of the M first DEMUX circuits comprises a1 first switches, wherein input terminals of the a1 first switches are electrically connected to the first signal input terminal, wherein an output terminal of each of the a1 first switches are electrically connected to one of the a1 first signal output terminals, and wherein control terminals of the a1 first switches are electrically connected to the a1 control signal lines respectively;

wherein each of the N second DEMUX circuits comprises b1 second switches, wherein input terminals of the b1 second switches being electrically connected to the second signal input terminal, wherein an output terminal of each of the b1 second switches is electrically connected to one of the b1 second signal output terminals, and wherein control terminals of the b1 second switches being electrically connected to b1 control signal lines of the a1 control signal lines respectively;

wherein each second DEMUX circuit of the N second DEMUX circuits comprises c1 dummy switches, wherein input terminals of the c1 dummy switches are electrically connected to the second signal input terminal, wherein control terminals of the c1 dummy switches are electrically connected to c1 control signal lines of the a1 control signal lines respectively, where c1 is a positive integer, and c1=a1−b1; and wherein the method for driving a display panel comprises:

sequentially providing a first electrical signal to the a1 control signal lines during a frame, wherein the first electrical signal controls turning on the a1 first switches, the b1 second switches, and the c1 dummy switches;

providing a data signal to the first signal input terminal when one of the a1 first switches is turned on;

providing a data signal to the second signal input terminal when one of the b1 second switches is turned on; and providing a data signal at a previous moment or a high-voltage signal to the second signal input terminal when one of the c1 dummy switches is turned on.

14. A display device comprising a display panel, wherein the display panel comprises:

a display area and a non-display area;

pixels arranged in H columns in the display area, each of the pixels comprising x sub-pixels;

H*x data lines arranged in the display area and electrically connected to the sub-pixels of the pixels;

a plurality of DEMUX circuits arranged in the non-display area, each of the plurality of DEMUX circuits comprising signal output terminals, each of the signal output terminals being electrically connected to one of the H*x data lines, and the display panel comprising exactly H*x data lines, a1 control signal lines arranged in the non-display area;

wherein the plurality of DEMUX circuits comprises M first DEMUX circuits and N second DEMUX circuits, each of the M first DEMUX circuits comprising a first signal input terminal and a1 first signal output terminals, and wherein each of the N second DEMUX circuits comprises a second signal input terminal and b1 second signal output, one of the M first DEMUX circuits shares one of the a1 control signal lines with one of the N second DEMUX circuits, and the display panel comprises exactly M+N DEMUX circuits;

where H*x=M*a1+N*b1, where H, x, M, N, a1, and b1 are positive integers, M>N, a1>2, b1≥2, a1>b1, and (M+N) is an even number;

wherein each of the M first DEMUX circuits comprises a1 first switches, wherein input terminals of the a1 first switches are electrically connected to the first signal input terminal, wherein an output terminal of each of the a1 first switches is electrically connected to one of the a1 first signal output terminals, and wherein control terminals of the a1 first switches are electrically connected to the a1 control signal lines respectively, and wherein each of the N second DEMUX circuits comprises b1 second switches, wherein input terminals of the b1 second switches are electrically connected to the second signal input terminal, wherein an output terminal of each of the b1 second switches are electrically connected to one of the b1 second signal output terminals, and wherein control terminals of the b1 second switches are electrically connected to b1 control signal lines of the a1 control signal lines respectively.

15. The display device according to claim 14, wherein the plurality of DEMUX circuits is sequentially arranged as a $1^{st}$ DEMUX circuit to a $(M+N)^{th}$ DEMUX circuit; and the N second DEMUX circuits comprise the $1^{st}$ DEMUX circuit to an $n1^{th}$ DEMUX circuit of the plurality of DEMUX circuits that are sequentially arranged, and a $(M+N-n2)^{th}$ DEMUX circuit to the $(M+N)^{th}$ DEMUX circuit of the plurality of DEMUX circuits that are sequentially arranged, where n1+n2=N and both n1 and n2 are positive integers.

16. The display device according to claim 14, wherein the plurality of DEMUX circuits is sequentially arranged as a $1^{st}$ DEMUX circuit to a $(M+N)^{th}$ DEMUX circuit; and the N second DEMUX circuits comprise the $1^{st}$ DEMUX circuit to an $N^{th}$ DEMUX circuit of the plurality of DEMUX circuits that are sequentially arranged or a $(M+1)^{th}$ DEMUX circuit to the $(M+N)^{th}$ DEMUX circuit of the plurality of DEMUX circuits are sequentially arranged.

17. The display device according to claim 14, wherein each second DEMUX circuit of the N second DEMUX circuits comprises c1 dummy switches, wherein input terminals of the c1 dummy switches are electrically connected to the second signal input terminal, control terminals of the c1 dummy switches being electrically connected to c1 control signal lines of the a1 control signal lines respectively, where c1 is a positive integer, and c1=a1−b1.

* * * * *